United States Patent [19]

Fleischmann et al.

[11] 4,053,278

[45] Oct. 11, 1977

[54] TUNNEL KILN

[75] Inventors: Werner Fleischmann, Frankfurt; Heinz-Otto Reinkenobbe; Manfred Schmidt, both of Ratingen, all of Germany

[73] Assignees: "Keramag" Keramische Werke AG, Ratingen; Firma Adolf A. Fleischmann, Frankfurt, both of Germany

[21] Appl. No.: 720,738

[22] Filed: Sept. 7, 1976

[30] Foreign Application Priority Data

Sept. 11, 1975 Germany ..... 2540401

[51] Int. Cl.[2] ..... F27B 9/00; F27D 1/00

[52] U.S. Cl. ..... 432/137; 110/1 A; 52/378; 432/247; 432/252

[58] Field of Search ..... 432/247–252, 432/244, 149, 134–137; 110/1 A, 1 R; 52/378

[56] References Cited

U.S. PATENT DOCUMENTS

| | | | |
|---|---|---|---|
| 2,074,874 | 3/1937 | Vogel | 110/1 A |
| 2,278,891 | 4/1972 | Munford | 432/250 |
| 2,572,242 | 10/1951 | Burchett | 432/251 |
| 3,159,944 | 12/1964 | Deming | 110/1 A |
| 3,587,198 | 6/1971 | Hensel | 52/378 |
| 3,854,865 | 12/1974 | Fay | 432/137 |
| 3,990,203 | 11/1976 | Greaves | 110/1 A |

*Primary Examiner*—John J. Camby
*Assistant Examiner*—Henry C. Yuen
*Attorney, Agent, or Firm*—Joseph A. Geiger

[57] ABSTRACT

A tunnel kiln consisting of a succession of tunnel sections assembled from prefabricated large-surface side panels and ceiling panels supported on a tunnel frame of structural steel, at least some of the panels being removable for access to the kiln. Similar panels mounted on railcars form the bottom portion of the kiln. The panels are composed of multiple layers of different materials, the material and thickness of the surface layers being adapted to different heat resistance requirements, while the overall dimensions of the composite panels remain the same.

16 Claims, 2 Drawing Figures

TUNNEL KILN

BACKGROUND OF THE INVENTION

1. Field of the Invention

The present invention relates to furnaces for the firing of ceramic objects and articles, and more particularly to a tunnel kiln for the firing of sanitary ceramic articles which are moved through the tunnel kiln on a series of railcars.

2. Description of the Prior Art

Firing furnaces in the form of tunnel kilns are not new, as reflected by the prior art in this field. However, prior art tunnel kilns are constructed in situ by erecting a gallery-type structure from furnace brick. Such a tunnel kiln may be reinforced by means of pilons, using traction anchors to hold the gallery walls. These prior art tunnel kilns are heated with either natural gas, or fossil fuel, or electrically. The heat may be introduced either directly or indirectly. In the case of direct heating, the burners or burner elements are arranged in the furnace cavity itself, in the case of indirect heating the kiln is equipped with special combustion chambers arranged in muffles.

These prior art tunnel kilns have several shortcomings and disadvantages. Among them are their elevated cost of initial construction, involving the use of refractory brick and requiring the work of highly skilled furnace bricklayers. In actual use, these tunnel kilns present various problems in connection with inspection and servicing, due to poor accessibility.

SUMMARY OF THE INVENTION

Underlying the present invention is the primary objective of providing an improved tunnel kiln of the tupe described further above which is designed for prefabrication of its component parts and which allows for a greatly simplified initial assembly operation, offering also ready accessibility for inspection and repairs, while being adaptable for operation under different temperature conditions and assuring extended longevity, thereby eliminating or greatly diminishing the earlier-mentioned prior art shortcomings.

The present invention proposes to attain these ends by suggesting a tunnel kiln which is constructed as a succession of tunnel kiln sections, each kiln section being composed of large-surface side panels and ceiling panels, the various panel members being attached to a stationary tunnel frame of structural steel.

The subdivision of the tunnel kiln into a succession of kiln sections and the use of large-surface panel members for the walls and ceiling of these sections makes it possible to achieve substantial economies of fabrication, inasmuch as the panel members can be prefabricated by the manufacturer on a production basis. Such a sectionalized tunnel kiln offers excellent adaptability to various operational requirements, even though the constituent panel members of the kiln sections are, at least outwardly, of identical structure dimensions.

A further advantage of the suggested tunnel kiln structure resides in the fact that the large panel members which constitute the walls and ceiling of the tunnel kiln require less frequent inspection and fewer repairs, due to the absence of brick joints which may develop cracks. The suggested novel panel construction also gives the kiln better heat insulation characteristics. The latter reflect themselves in corresponding savings in energy expense and in shorter warmup and cooling times for startup and shutdown, respectively.

The building-block-type design of the novel tunnel kiln is not only well suited for a quick and simple initial assembly operation, it also lends itself for convenient disassembly for access and repairs, if necessary. These assembly and disassembly operations require only unskilled or semi-skilled personnel. Basically similar wall panels of the kiln sections can readily be adapted for different operational conditions, by using composite panels which consist of multiple layers and by adapting these layers in terms of material and thickness to the particular operational needs, especially as far as temperature resistance and insulation are concerned.

The various panels of each structural section are independently supported on the supporting frame of the tunnel kiln, and the mounting arrangements are such that only minimal bending and distortion effects are produced on the tunnel frame, thereby making it possible to use a very simple, low cost steel structure for that frame.

The preferred embodiment of the invention further suggests that the ceiling panels of at least some of the kiln sections be designed to serve as removable lids, bridging the tunnel frame from side to side and simply resting on top of the latter. Besides being of very simple construction, these removable ceiling panels provide ready access to the tunnel kiln from above for repairs, or in the event of an equipment breakdown inside the tunnel kiln. For this purpose, the removable ceiling panels are simply provided with appropriate hoisting hooks, a suitable overhead crane being used to lift the ceiling panels from the kiln.

The present invention further suggests that a ceiling panel adjacent to a removable ceiling panel be provided with suitable supporting trestles on which the raised ceiling panel can rest while removed from its normal position, the ceiling panel with the supporting trestles being preferably fixedly mounted on the tunnel frame in such a way that its trestles bear directly on that frame. In a similar manner, the invention also provides for at least some of the lateral panel members on at least one side of the tunnel kiln to be removable, in order to provide lateral access to the interior of the tunnel kiln, if needed.

The present invention further suggests, by way of a preferred embodiment, lateral panels and ceiling panels which are composed of multiple layers of different materials, held together by means of appropriate wall anchors. Thus, it is possible to provide kiln section panels of identical overall dimensions with different refractory and insulating characteristics, by selecting appropriate materials and wall thicknesses for the constituent layers of each composite panel. For instance, a given firing kiln operates with different temperature levels in different zones along its length, the temperature in the preheating zone increasing gradually to a maximum level in the firing zone, whose length depends on the required firing time, and decreasing thereafter in a cooling zone. The tunnel sections in the various operational zones of the kiln, while being of uniform cross section, can thus be made of different materials, in adaptation to the specific heat load, thus bringing further reductions in cost, as less expensive materials can be employed for those kiln sections which are subjected to lower temperatures.

The present invention further suggests that the panel members which make up the sides and the top of a tunnel section be joined with a labyrinth-type gap, both in the cross-sectional sense and in the longitudinal sense, thereby allowing for limited expansion and contraction displacements under changing temperatures, while giving excellent insulation results.

In a preferred embodiment of the invention, the railcars constitute the bottom element of the kiln tunnel cross section, each car carrying a multi-layer bottom panel. Successive panels are carried by coupled cars, forming longitudinal gap joints therebetween which are likewise of the labyrinth type. The side panels of each kiln section reach preferably to the bottom edge of the car-carried bottom panel which is spaced a distance from the floor on which the rails are mounted. This arrangement makes it possible to eliminate the previously necessary prior art access gallery. An additional advantage afforded by this arrangement is that the wheels and wheel bearings of the rail cars are located in a cool zone of the tunnel. Furthermore, lateral access to the rails and to the railcar understructure, especially to the wheel bearings, is improved.

These various advantages of assembly and servicing access are made possible by the present invention, as a result of the suggestion that the constituent elements of the kiln tunnel be large-surface panel members which are independently mounted on a supporting tunnel frame. The frame alone rests on the floor and, because of its simple, but rigid construction, allows for the convenient and quick emplacement and attachment of the panel members. Rather than using the costly vault-type cross-sectional outline of prior art tunnel kilns, the tunnel kiln of the invention suggests a convenient rectangular outline defined by only four large panel members, three of which are anchored in place, while the fourth is carried on a railcar.

By way of a further improvement, the present invention also suggests the arrangement of longitudinal channels filled with sand on the lower inner edges of the side panels and cooperating skirt flanges on the railcars which reach into the sand, thereby providing an effective seal between the cars and the kiln side panels. These sealing channels are preferably removably attached to the supporting structure for the side panels.

Lastly, the present invention also suggests that certain structural elements of the steel frame of the tunnel kiln be adapted to serve as air channels for the supply of combustion air to the tunnel kiln, thereby eliminating the need for separate air supply conduits.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows.

DESCRIPTION OF THE PREFERRED EMBODIMENT

Figure 1:
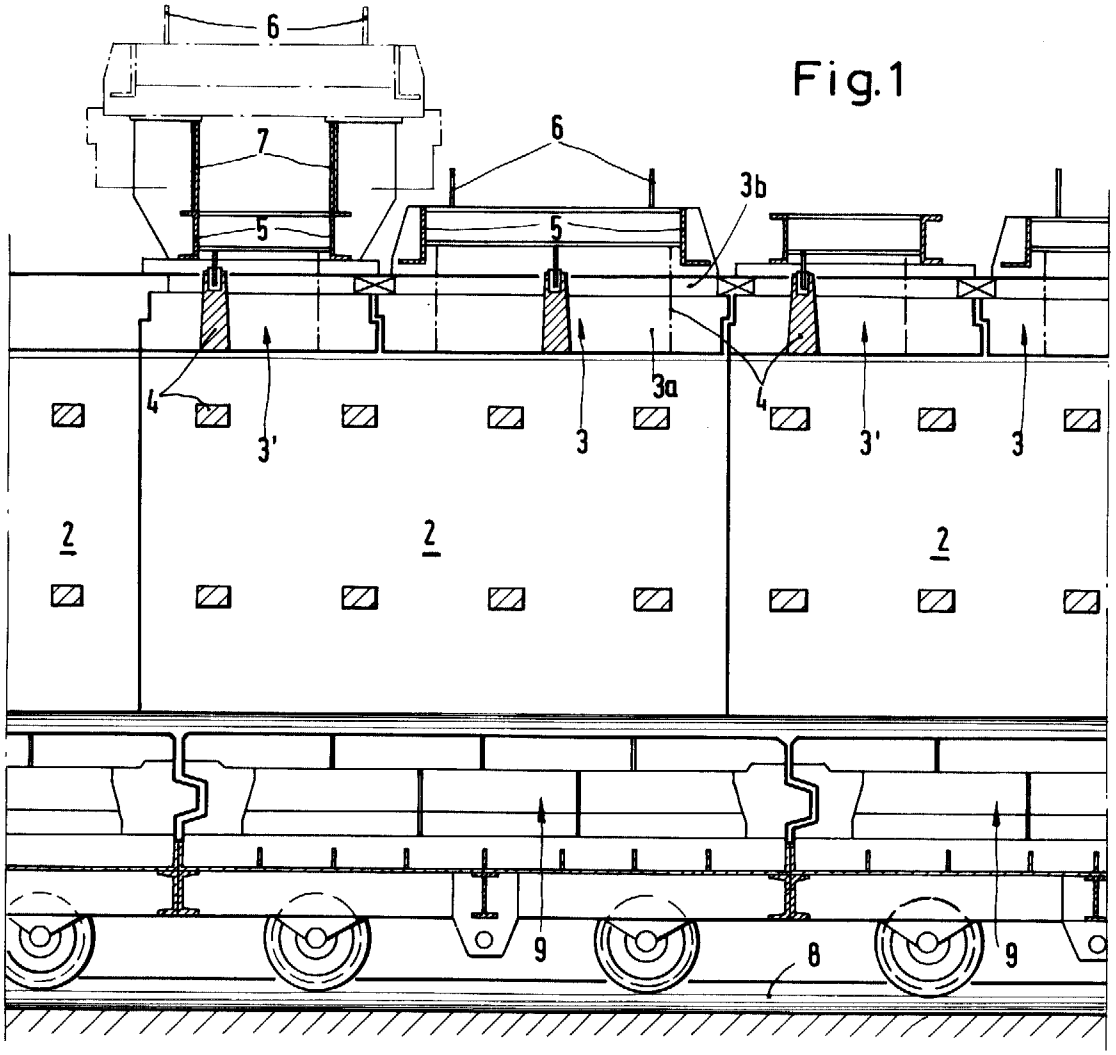
FIG. 1 represents a longitudinal cross section through a length portion of a tunnel kiln embodying the invention.
Figure 2:
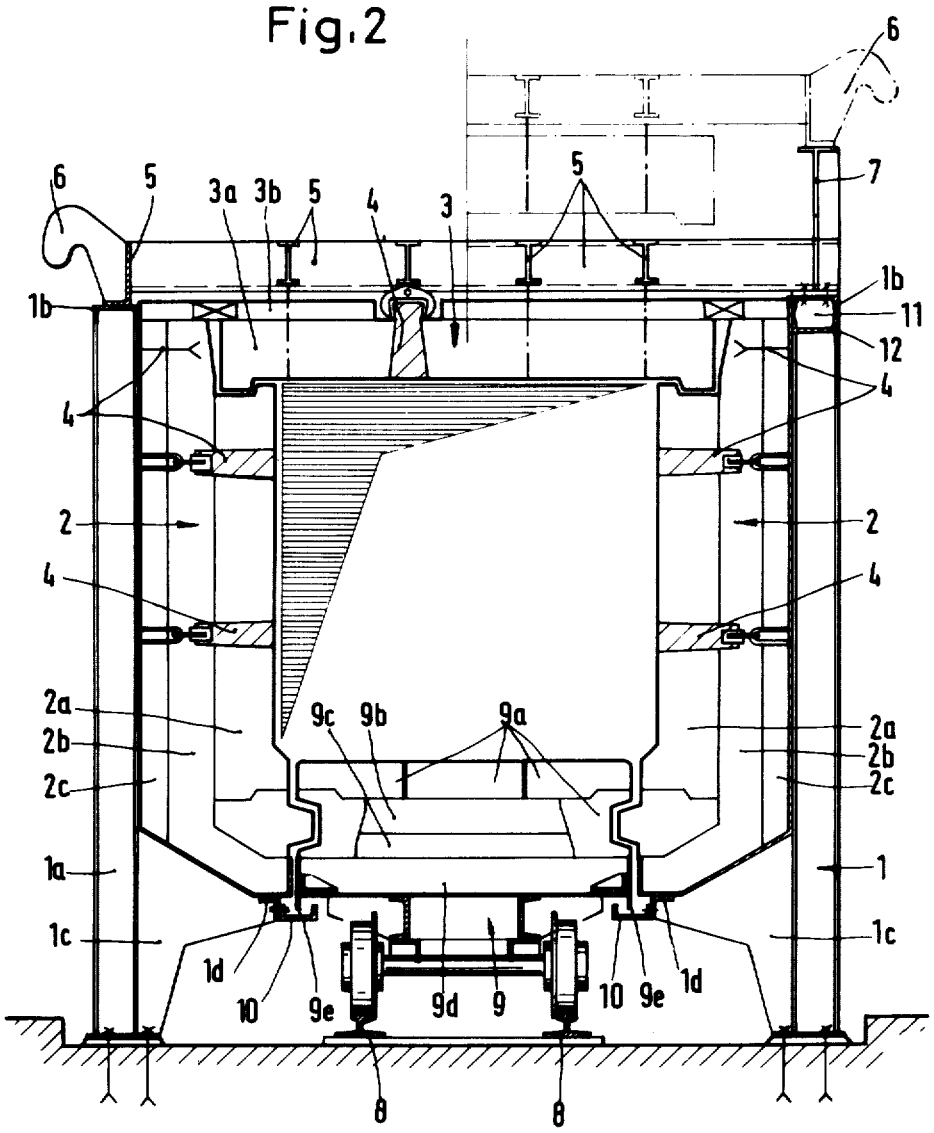
FIG. 2 represents a transverse cross section through the tunnel kiln of FIG. 1.

The tunnel kiln illustrated in FIGS. 1 and 2 consists of a longitudinal succession of tunnel kiln sections, one complete section and portions of adjacent sections being visible in FIG. 1. Extending along the entire length of the tunnel kiln is a stationary tunnel supporting frame 1 of structural steel. This frame consists essentially of a succession of simple upright frame members 1*a* and longitudinally oriented horizontal frame members 1*b* which connect the uprights at their upper extremities. To the bottom inside portion of each upright 1*a* is attached a supporting gusset 1*c*, reaching inwardly from the tunnel frame. Longitudinally extending supporting angles 1*d* interconnect the supporting gussets at their innermost extremities.

Each tunnel kiln section is composed of only four generally flat panel members: two substantially identical side panels 2, a ceiling panel 3, and a bottom panel 9 in the form of a longitudinally movable railcar. These constituent panels are large-surface panels and, as such, they lend themselves ideally for prefabrication by the kiln manufacturer on a production basis. By way of example, each panel member may have a length of 2 meters, so that a tunnel kiln of 30 meters overall length would consist of fifteen tunnel sections.

The panel members which constitute the walls of the tunnel kiln are preferably composed of several superposed panel layers, as indicated in FIG. 2, where it can be seen that the side panels 2 consist of layers 2*a*, 2*b*, and 2*c*, the ceiling panel consists of layers 3*a* and 3*b*, and the bottom panel on the rail car 9 consists of layers 9*a*, 9*b*, and 9*c*. Only the exposed surface layers 2*a*, 3*a*, and 9*a* need to be of refractory material. Suitable wall anchors 4 clamp the various layers of the panels together and attach the composite panel members to the supporting tunnel frame 1.

As can be seen in FIG. 2, the heavy side panels 2 of the tunnel kiln are supported from underneath, by the gussets 1*c* and the longitudinal supporting angles 1*d*. The ceiling panels 3 rest on top of the tunnel frame 1, bridging the longitudinal frame members 1*b*. For this purpose, the layers 3*a* and 3*b* of each ceiling panel 3 are attached from underneath to a rigid framework of longitudinal and transverse joists 5, being clamped against the latter by means of wall anchors 4.

In FIG. 1, it can be seen that the ceiling of a tunnel kiln section consists actually of two ceiling panels 3 and 3′, which are arranged one behind the other in the longitudinal sense. The ceiling panel 3, which is the larger one of the two panels, thereby serves as a removable lid. For this purpose, the bridge joists 5 of the ceiling panel 3 have attached thereto four hoisting hooks 6. The adjacent fixed ceiling panel 3′, while being generally similar in structure to the removable ceiling panel 3, features supporting trestles 7 on both lateral ends which are adapted to carry the raised ceiling panel 3. An extremely simple and quick mode of access to the tunnel kiln is thus available: With an overhead crane mounted above the tunnel kiln, a ceiling panel 3 is simply raised and deposited on the trestles 7 of the adjacent ceiling panel 3′. A removed ceiling panel is shown in dotted lines in FIG. 1 and on the right-hand side of FIG. 2.

The bottom section of the tunnel kiln is formed by a series of railcars 9 (FIG. 1) which rest on a pair of longitudinal guide rails 8, mounted on the floor between the upright frame members 1*a* of the tunnel frame 1. Each railcar 9 carries a large-surface composite panel with three layers 9*a*, 9*b*, and 9*c*, comparable to the three layers of the composite side panels 2. The articles to be fired in the tunnel kiln rest on the upper layer 9*a*, which is of refractory material, as the railcars move through the tunnel kiln. The railcars 9 thus form a moving section of the kiln, while maintaining a substantially leakproof enclosure, in spite of the movement. For this purpose, there are arranged, below the lateral longitudinal edges of the lower panel layer 9c of the railcars 9, two stationary channels 10 which are filled with sand. Into these sand-filled channels reach skirt flanges 9e of the railcars 9 which are attached to the chassis of the latter. The result is a very effective moving seal between the side panels 2 and the railcars 9. The channels 10 are preferably removably attached to the supporting angles 1d of the tunnel frame 1.

As the drawings further indicate, the various joints between adjoining fixed panels of the tunnel kiln and between the fixed side panels and the moving railcars 9 form labyrinth-type seals, in order to minimize heat leaks along the tunnel kiln. The labyrinth configuration between the sides of the railcars 9 and the bottom portions of the side panels 2, because it requires a larger clearance to accommodate the movement of the railcars 9, is backed up by the sand-filled channels 10, as just described. The labyrinth seals between stationary panels can be packed tight after assembly, if necessary. Similar labyrinth gaps are provided between the fixed ceiling panels 3' and the removable ceiling panels 3.

FIG. 2 also shows, in the upper right-hand corner of the tunnel frame 1, how the latter can be modified to provide an air conduit 11 for the supply of combustion air to the tunnel kiln. This is conveniently accomplished by using as the connecting frame member 1b an inverted channel profile and by adding to it a similar bottom profile 12, thereby creating a hollow rectangular profile for the air conduit11.

The use of multiple panel layers for the large-surface panels which constitute each kiln tunnel section makes it possible to adapt the various sections to varying operational requirements, especially in terms of necessary heat resistance, which are encountered along the extent of the tunnel kiln. While maintaining identical overall dimensions for all panels, it is thus possible to use materials of lesser heat resistance, or thinner layers of the more expensive materials, for those tunnel kiln sections which are subjected to lesser temperatures. It should be understood that the number and arrangement of the layres in the various composite panels, as described, are given by way of example only, and that their number, thickness and arrangement may be readily modified in adaptation to different operational requirements.

Accordingly, it should be understood that the foregoing disclosure describes only a preferred embodiment of the invention and that it is intended to cover all changes and modifications of this example of the invention which fall within the scope of the appended claims.

We claim the following:

1. A structure for a tunnel kiln enclosure of substantially rectangular interior cross-sectional outline, especially a kiln for the firing of ceramic objects on a production line basis, under continuous or intermittent motion, the tunnel kiln structure comprising in combination:

a tunnel frame of structural steel extending the length of the tunnel kiln and including upright frame sections on both sides thereof;

a plurality of longitudinally adjoining tunnel kiln sections, each of said kiln sections including a unitary prefabricated heat resistant ceiling panel extending transversely over the entire width of the kiln enclosure and being supported by said upright frame sections, and a similar unitary prefabricated heat resistant side panel on each side of the kiln extending over the entire height of the kiln enclosure, the side panels being likewise supported on said upright frame sections;

a plurality of longitudinally adjoining rail cars carrying thereon similar unitary prefabricated heat resistant bottom panels which form a movable bottom for the tunnel kiln enclosure; and guide rails supporting the rail cars, the rails being mounted in parallel alignment with the tunnel frame.

2. A tunnel kiln structure as defined in claim 1, wherein the two upright frame sections of the tunnel frame are colonnade-like structures, having upright frame members which are interconnected at their upper ends by horizontal frame members extending in parallel longitudinal alignment.

3. A tunnel kiln structure as defined in claim 2, wherein the two upright frame sections further include supporting gussets attached to the lower end portions of their upright frame members and extending inwardly therefrom towards the railcars; and the weight of the side panels of the tunnel kiln structure rests on said supporting gussets.

4. A tunnel kiln structure as defined in claim 3, wherein the supporting gussets of each tunnel frame section are interconnected at their inner edges by a longitudinally extending supporting member.

5. A tunnel kiln structure as defined in claim 2, wherein the prefabricated ceiling panels include rigid joists which extend between, and are supported by the horizontal frame members of the two upright frame sections, so that substantially the entire weight of the ceiling panels is supported directly by the tunnel frame.

6. A tunnel kiln structure as defined in claim 1, wherein at least some of the prefabricated ceiling panels which form the tunnel kiln enclosure are freely liftable and removable, for service access to the inside of the enclosure, the removable ceiling panels being supported on top of the upright frame sections.

7. A tunnel kiln structure as defined in claim 6, wherein the removable ceiling panels have hoisting hooks attached thereto; and at least some of the ceiling panels include means for supporting a removed ceiling panel thereon.

8. A tunnel kiln structure as defined in claim 6, wherein at least some of the prefabricated side panels of the tunnel kiln enclosure are detachable from their supporting upright frame sections, being thereupon removable, following prior removal of the associated ceiling panels.

9. A tunnel kiln structure as defined in claim 1, wherein the prefabricated panels which form the walls of the tunnel kiln enclosure are composite panels, comprising several superposed panel layers of different material characteristics.

10. A tunnel kiln structure as defined in claim 9, wherein the surface layer of said composite wall panels is a layer of refractory material.

11. A tunnel kiln structure as defined in claim 9, wherein the overall tunnel kiln enclosure includes length portions which are designed for different levels of heat exposure; and the side panels and ceiling panels of the tunnel kiln sections in these different length portions of the enclosure are constituted of composite panels of correspondingly different heat resistance characteristics, while the overall dimensions of each of said panels in the prefabricated state are substantially the same from kiln section to kiln section.

12. A tunnel kiln structure as defined in claim 1, wherein the prefabricated panels which form the walls of the tunnel kiln enclosure adjoin each other with labyrinth-type gaps.

13. A tunnel kiln structure as defined in claim 1, wherein the bottom panels carried by the railcars are substantially rectangular in their cross-sectional outline, having their lower longitudinal edges spaced a substantial distance from the ground; and the side panels reach downwardly to the level of said lower edges of the bottom panels, forming substantially vertically oriented movement gaps with both longitudinal sides of the bottom panels.

14. A tunnel kiln structure as defined in claim 13, further comprising a pair of horizontal, upwardly open sand-filled channels mounted underneath the two movement gaps and closed on their outer sides against the lower ends of the side panels; and downwardly extending skirt flanges on both sides of the railcar-carried bottom panels reaching into the sand-filled channels so as to form a moving seal therewith.

15. A tunnel kiln structure as defined in claim 14, wherein the tunnel frame includes, as part of its two upright frame sections: a row of upright frame members on each side of the tunnel kiln; side panel supporting gussets attached to the lower end portions of said frame members and extending inwardly towards the movement gaps between the railcar-carried bottom panel and the side panels; and a longitudinal supporting member interconnecting the supporting gussets near said movement gaps; and the sand-filled channels are detachably mounted on said supporting members.

16. A tunnel kiln structure as defined in claim 1, wherein the tunnel frame includes hollow longitudinal frame members serving as air conduits for the supply of combustion air to the tunnel kiln.

* * * * *